United States Patent [19]

Maccarinelli

[11] 4,441,873

[45] Apr. 10, 1984

[54] MACHINE FOR FORMING PREFABRICATED BUILDING COMPONENTS

[76] Inventor: Edoardo Maccarinelli, Via Gramsci 30, Brescia, Italy

[21] Appl. No.: 357,720

[22] Filed: Mar. 12, 1982

[30] Foreign Application Priority Data

Mar. 20, 1981 [IT] Italy ..... 5135 A/81

[51] Int. Cl.[3] ..... B28B 7/22

[52] U.S. Cl. ..... 425/64; 249/21; 249/36; 249/129

[58] Field of Search ..... 249/155, 158, 20, 21, 249/123, 129, 131, 36; 425/88, 404, 64; 264/33, 35

[56] References Cited

U.S. PATENT DOCUMENTS

| | | | |
|---|---|---|---|
| 1,100,452 | 6/1914 | Stehm | 249/158 |
| 2,489,604 | 11/1946 | Woods | 249/158 |
| 3,868,207 | 2/1975 | Otsuki | 425/88 |
| 3,874,832 | 4/1975 | Ohta | 425/88 |
| 3,881,856 | 5/1975 | Fougea | 249/158 |
| 3,931,951 | 1/1976 | Fougea | 249/158 |

*Primary Examiner*—Donald E. Czaja
*Assistant Examiner*—James C. Housel
*Attorney, Agent, or Firm*—McGlew and Tuttle

[57] ABSTRACT

The machine for prefabricating components comprises at least one fixed frame having an internal vertical wall and an intermediate movable frame having at least one vertical wall opposite and variably spaced apart from said vertical wall of the fixed panel. The space between the opposed panels may receive ready-mixed materials, for formation of the prefabricated components, from one or more mixing vessels mounted on the intermediate frame. The spaces are further delimited by panels which may support reinforcing meshes for incorporation into the prefabricated components or rods for producing perforated prefabricated components.

4 Claims, 8 Drawing Figures

Fig. 5
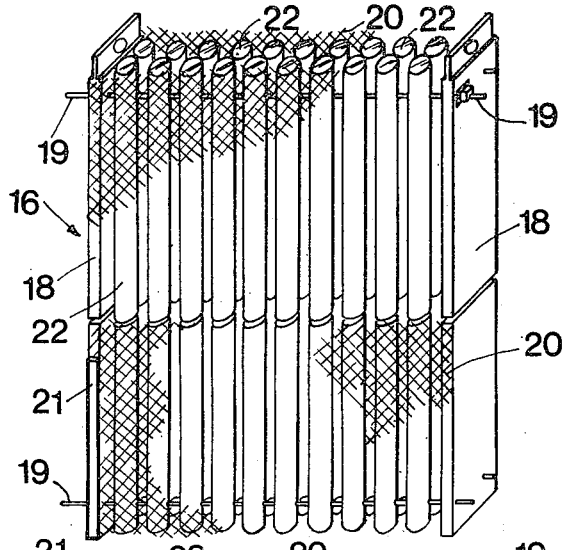
Fig. 5a
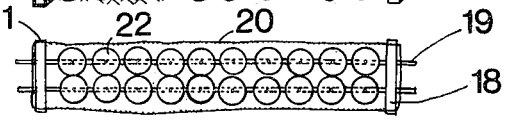
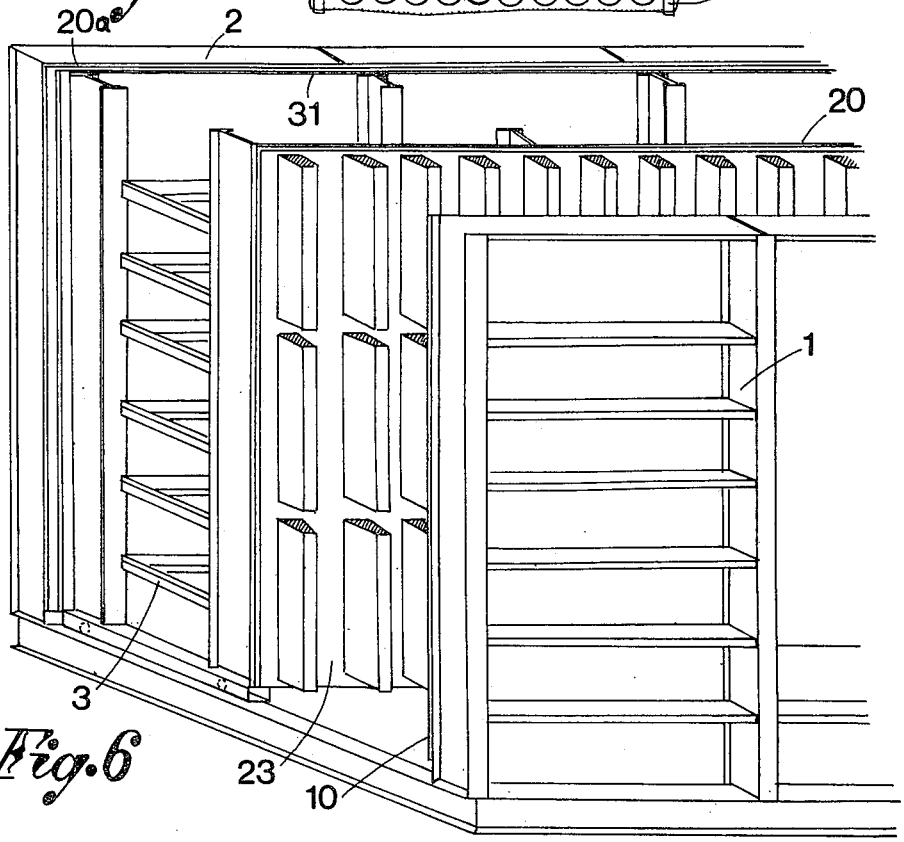
Fig. 6

MACHINE FOR FORMING PREFABRICATED BUILDING COMPONENTS

FIELD AND BACKGROUND OF THE INVENTION

The present invention relates to a machine for forming prefabricated building components of various shapes, dimensions and characteristics which can be used in the construction of buildings.

The use of prefabricated components for use as masonry in dwelling houses, industrial buildings, etc., is already known in the building industry and in accordance with the known techniques these components are normally made of agglomerates based on cement and inert materials with metal reinforcement, as appropriate. The said components are generally manufactured in suitable yards with appropriate equipment after which the components, when ready, are transported to the construction site where they are to be used. This however entails that the components should first be stacked and available, and subsequently entails difficulties and expense in moving and transporting the components on site.

SUMMARY OF THE INVENTION

An object of this invention however is to propose a machine for the forming of prefabricated components for the building industry which can be used directly on the site where the components themselves are to be used in building.

Another object of the invention is to propose a machine which can be driven from one site to another and is capable of forming even large sized components having characteristics compatible with the requirements of the buildings which are to be constructed.

Another object is to propose a machine with a high production capacity and a low labour requirement which is capable of producing solid or light or hollow components of an agglomerate based on gypsum and inert materials reinforced with a grid reinforcement of plastic or metal which are intended for the construction of loadbearing external walls and external curtain walls, dividing walls, internal walls, floors, ramp panels and stair landings, finishing panels for columns or panels acting as formwork for the construction of reinforced concrete columns and beams etc.

Another object of the invention is to propose a machine which is capable of producing a very large range of prefabricated components for the building industry which have a perfectly smooth surface thus avoiding the need for rendering or subsequent plastering.

According to the present invention there is provided a machine for forming prefabricated components for the building industry, comprising: at least one fixed lateral frame having an internal vertical wall panel providing a smooth continuous surface; an intermediate frame which can be moved and positioned with respect to the said fixed lateral frame and itself having at least one vertical wall panel with a smooth continuous surface parallel to and facing the wall of the said lateral fixed frame to define a space between them, the breadth of which can be varied at will; at least one mixing vessel for preparation of the mixture which is intended to form the prefabricated component, the said vessel or each of the vessels being mounted on the top of the said movable frame and being capable of being tipped in the direction of the space defined at any given time by the said opposing walls of the fixed frame and the movable frame; horizontal and vertical means which can be positioned between these opposing walls to define the thickness and length of the component which is to be manufactured and which can carry means for reinforcing and/or perforating the said component; and means for the measured addition of the starting materials to the said at least one mixing vessel.

BRIEF DESCRIPTION OF THE DRAWINGS

The present invention will be described further, by way of example, with reference to the accompanying drawings, in which:

FIGS. 5 and 5*a* show a second example of a double sided mould for floor panels; and FIG. 6 shows an enlarged perspective view similar to FIG. 1.

DESCRIPTION OF THE PREFERRED EMBODIMENT

Figure 1:
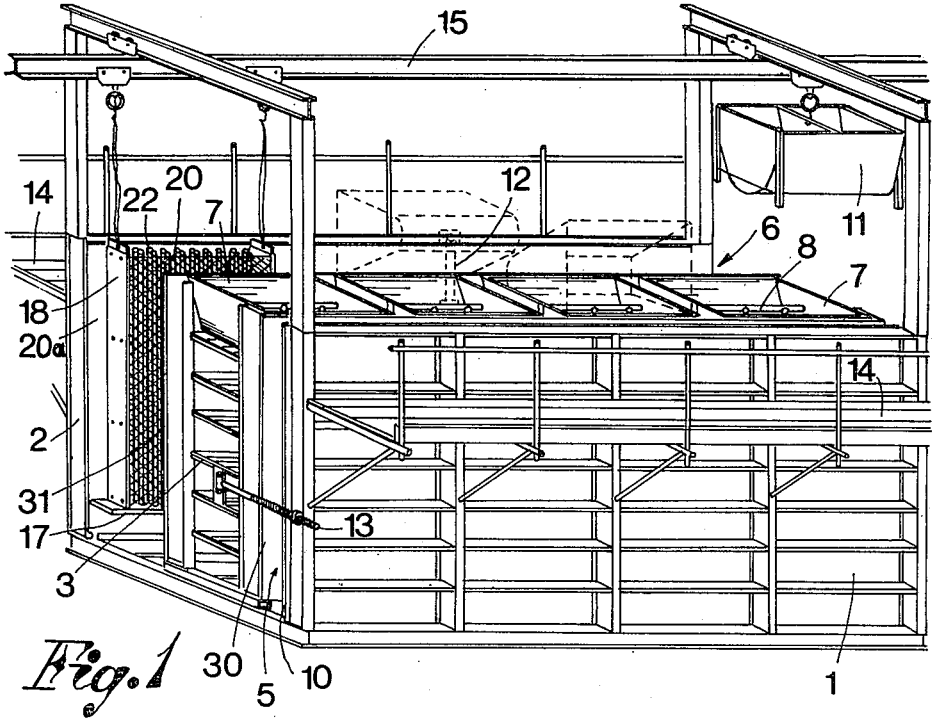
FIG. 1 shows a perspective view of the frame of the machine.
Figure 2:
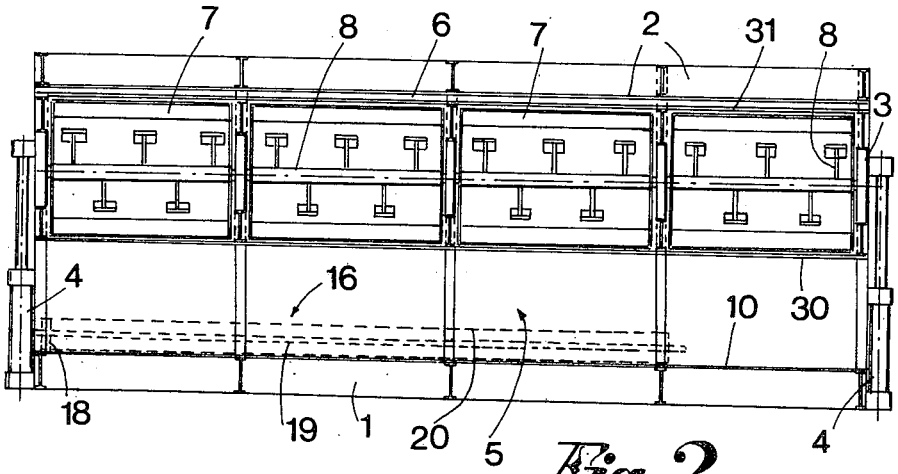
FIG. 2 shows a diagrammatic view in plan.
Figure 3:
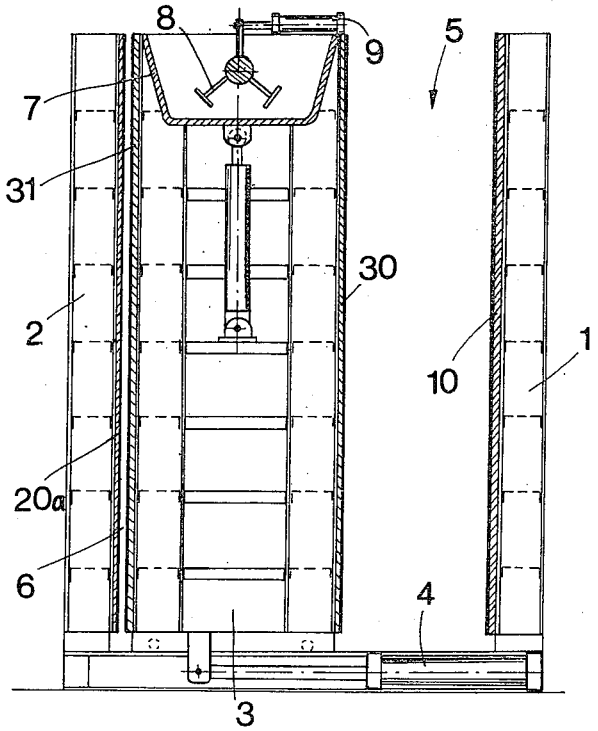
FIG. 3 shows a diagrammatic transverse cross-section.

The machine in question comprises at least one, or preferably two, fixed lateral frames 1 and 2, as shown in the drawing, placed parallel to and at a distance from one another, and an intermediate movable bilateral frame 3 which can be displaced towards one or other of the said fixed frames, the said movable frame being guided at least at its base and connected to pneumatic pistons 4 for movement and positioning with respect to the fixed frames.

Each fixed frame 1, 2 has a respective internal vertical wall 10 and 20*a* consisting of panels to provide a smooth continuous surface over the full height and length of the corresponding fixed frame. Likewise movable frame 3 has two vertical walls 30 and 31, parallel and oppoiste to the respective internal wals 10, 20*a* of the fixed frames 1 and 2, likewise consisting of panels to provide smooth and continuous surfaces, the said panels being, for example, of wood treated with appropriate resins, although other appropriate materials could be used.

In practice, walls 10 and 20*a* of the fixed lateral frames 1 and 2 and walls 30 and 31 of movable frame 3 comprise two moulds having a breadth which is variable and adjustable by means of the displacement of movable frame 3 towards one or other fixed wall 10 or 20*a* in such a way as to delimit at any time a space 5 or 6 of the desired breadth between the two opposing fixed and movable walls within which the building component or panel is to be formed.

One or more vessels 7, which are aligned with each other and each including a tipping mixing device 8 controlled, for example, by a pneumatic piston 9, are mounted on top of movable frame 3, and move with it. The starting ingredients for the mixture, from which the desired components or panels are to be formed, are placed in the vessel or vessels 7 by means of appropriate metering containers 11 associated with the machine. The vessel or vessels 7 are hinged about an axis orientated along the length of movable frame 3 and each is connected to at least one pneumatic piston 12 in such a way that it can be tipped individually to one side or the other in order to send the prefabricating component mixture into space 5 or 6, which is being used at the time for the manufacture of components or panels.

Movable frame 3 is also fitted at its opposite ends with locking devices consisting, for example, of bolts 13 which act to secure movable frame 3 to one or other of the fixed lateral frames 1 or 2 in order to withstand the forces which are generated when the mixture is poured into the space 5 or 6, used to form the panel, and to ensure a tight seal around the space, as will become apparent below.

Finally the machine is provided with lateral walkways 14 for the operators engaged in manufacture, means 15 for suspending and sliding the metering containers 11 and means 16 for delimiting the dimensions of the components which are to be made at any time.

Figure 4:
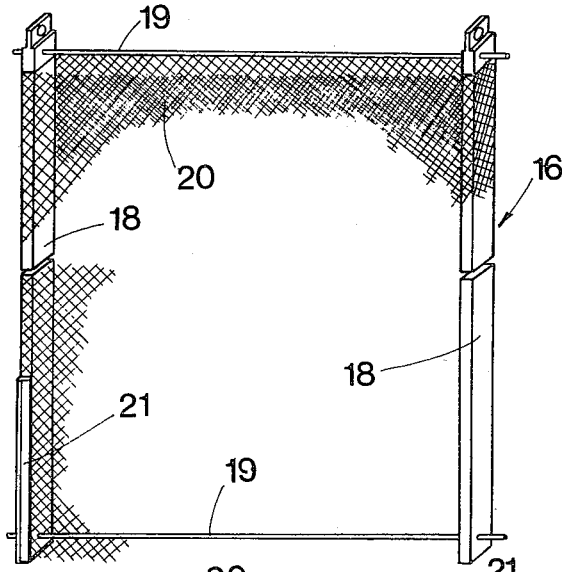
FIGS. 4 and 4*a* show a first example of reinforcement which can be positioned inside the machine in order to define and form a solid panel.
Figure 4A:
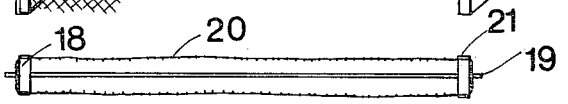

In particular means 16 include: a horizontal section 17 intended to be placed at the base of space 5 or 6 and used in forming; a pair of end moulds 18 which can be connected together by means of tie rods 19, as shown in FIGS. 4 and 5, which are also intended to support e.g. one or more plastic or metal mesh elements 20 which provide the reinforcement for the component which is to be produced, and sealing members 21 which can be applied to either side of the said horizontal section 17 and the said moulds 18 facing the fixed and movable walls bounding space 5 or 6, the said sealing members 21 comprising e.g. flat supports with rubber covered faces.

Obviously the base section 17 and the end moulds will be selected to have the appropriate breadth and height for the thickness of the panel or the like which is to be manufactured and the said moulds and/or their corresponding tie rods can, where necessary, be secured by members 22 which are intended to form vertical holes in the cross-section of the panel or the like.

Components of any length, breadth and thickness compatible with the maximum dimensions of the vertical walls 10, 20*a*, 30, and 31 of the fixed and movable frames of the machine may be manufactured in space 5 or 6 of the machine, which is used for the forming of building components. However, once the dimensions of the panel which is to be manufactured have been decided upon and the appropriate means 17, 18, 19, 20, 21 and 22 have been placed in position, e.g. in space 5, movable frame 3 is held and secured by means of the securing members or bolts 13 to frame 1 as shown in FIG. 1 in order to delimit and provide a leaktight seal on three sides of the space 5 defined by walls 10 and 30.

The mixture is then prepared in the mixing vessels 7 and poured into the said space 5 by tipping the said vessels 7. As soon as the mixture has reached a sufficient degree of hardness it can be turned out and movable frame 3 can be moved away from the fixed frame to release the panel or component obtained. This can then be picked up by a lifting device and once freed, by removing moulds 18, it can be used immediately or at a later date.

Floor panels of the desired dimensions can likewise be constructed using a suitable mould 23, e.g. one of the type illustrated in FIG. 6 and placed in space 5 or 6 of the machine used for forming components.

Units purposely placed for the formation of electrical, water or sanitary installations, false ceilings, etc., can also be incorporated into the panel at the time of its manufacture.

It will be clear from the above that the machine described makes it possible to manufacture prefabricated components for the building industry, preferably for use on site, easily, rapidly and economically, thus fulfilling the objects mentioned earlier, and to construct buildings in a manner which is both rapid and accurate. Modifications may be made to the structure of the machine as a whole and to the function of its corresponding parts without going beyond the scope of the invention as set forth in the appended claims.

I claim:

1. In a machine for forming prefabricated components for the building industry from a prefabricating component mixture, the combination of:

two fixed lateral frames arranged parallel to and at a distance from each other, each having an internal vertical wall panel provided with a smooth continuous surface facing the surface of the panel of the other fixed frame, an intermediate movable bilateral frame arranged between the two fixed frames and having two corresponding vertical wall panels each provided with a smooth continuous surface opposite to a corresponding facing surface of the two wall panels of the two panels of the fixed frames, said movable frame being arranged for guided alternate movement horizontally toward and away from each of the fixed frames and thereby defining two alternative mold spaces of variable breadth between the surfaces of the movable frame and the corresponding opposite facing surfaces of the fixed frames, which mold spaces can be used alternative for forming prefabricated components, said movable frame being fitted with locking devices securable, when the machine is in use, on one or the other of said fixed frames, at least one mixing vessel for preparation of the mixture which is intended to form the prefabricated component, said at least one vessel being mounted on the top of said movable frame and being capable of being alternately tipped in the direction of each mold space defined between the movable frame and the two corresponding fixed frames, horizontal and vertical means arranged for positioning alternatively between the opposing surfaces defining each mold space for defining the thickness, height and length dimensions of the component which is to be manufactured in the corresponding mold space, said means consisting of a horizontal section arranged for positioning in the bottom of the corresponding mold space, and a pair of opposed vertical end molds arranged for interconnection by means of tie rods and adapted to support reinforcing means and/or mold the component to be formed and means for the measured addition to the at least one mixing vessel of the starting materials for providing said mixture.

2. Machine of claim 1, wherein the at least one mixing vessel is hinged at the top of the movable frame on an axis oriented along the length of the movable frame itself and is connected to a corresponding pneumatic piston in order to tip the vessel alternately toward each mold space, and correspondingly including in the at least one mixing vessel a mixing device activated by a pneumatic piston.

3. Machine of claim 1, wherein hydraulic sealing members are provided on each of the sides of the horizontal section and the end molds for sealing the boundaries of the mold space thereat.

4. Machine of claim 3, wherein the sealing hydraulic means correspondingly comprise a support having thereon a covering of rubber or the like.

* * * * *